US008704432B2

(12) United States Patent
Jin

(10) Patent No.: US 8,704,432 B2
(45) Date of Patent: Apr. 22, 2014

(54) LED LAMP

(75) Inventor: Sung Ho Jin, Ansan (KR)

(73) Assignee: Seoul Semiconductor Co., Ltd., Seoul (KR)

( * ) Notice: Subject to any disclaimer, the term of this patent is extended or adjusted under 35 U.S.C. 154(b) by 47 days.

(21) Appl. No.: 13/410,901

(22) Filed: Mar. 2, 2012

(65) Prior Publication Data

US 2012/0300429 A1 Nov. 29, 2012

(30) Foreign Application Priority Data

May 25, 2011 (KR) ..... 10-2011-0049505
Jan. 20, 2012 (KR) ..... 10-2012-0006715

(51) Int. Cl.
*H01J 1/02* (2006.01)

(52) U.S. Cl.
USPC ..... 313/46; 362/294

(58) Field of Classification Search
USPC ..... 362/294; 313/46
See application file for complete search history.

(56) References Cited

U.S. PATENT DOCUMENTS 6,465,961 B1 * 10/2002 Cao ..... 315/58
7,960,872 B1 * 6/2011 Zhai et al. ..... 307/157
2003/0063476 A1 * 4/2003 English et al. ..... 362/545
2008/0130288 A1 * 6/2008 Catalano et al. ..... 362/294
2010/0320499 A1 * 12/2010 Catalano et al. ..... 257/99

* cited by examiner

*Primary Examiner* — Mary Ellen Bowman
(74) *Attorney, Agent, or Firm* — H.C. Park & Associates, PLC

(57) ABSTRACT

Exemplary embodiments of the present invention relate to an LED lamp including a substrate, a first LED, a second LED, a heat sink, and a transparent cover. The first LED is arranged on a first surface of the substrate. The second LED is arranged on a second surface of the substrate, the second surface being an opposite side of the substrate from the first surface. The heat sink has a mounting surface on which the substrate is arranged. The heat sink also has a reflection surface. The transparent cover covers the substrate, the first LED, and the second LED.

27 Claims, 19 Drawing Sheets

(a)

(b)

(a)

(b)

LED LAMP

CROSS-REFERENCE TO RELATED APPLICATIONS

This application claims priority from and the benefit of Korean Patent Application No. 10-2011-0049505, filed on May 25, 2011, and Korean Patent Application No. 10-2012-0006715, filed on Jan. 20, 2012, which are both hereby incorporated by reference for all purposes as if fully set forth herein.

BACKGROUND OF THE INVENTION

1. Field of the Invention

The present invention relates to a light-emitting diode (LED) lamp, and more particularly, to an LED lamp in which LEDs are respectively mounted on top and bottom surfaces of a substrate so that light can be radiated not only in a forward direction but also in a rearward direction of the substrate, thereby obtaining a characteristic of light distribution similar to that of an incandescent lamp.

2. Discussion of the Background

Light-emitting diodes (LEDs) may used as light sources in various fields because of characteristics such as high efficiency and definition. A conventional lamp may be replaced with an LED lamp, and LEDs may be applied in the illumination field.

The orientation angle of an LED lamp may be 120 degrees, which is the conventional orientation angle of an LED used as a light emitting source. Conventionally, when an LED has been used as a lamp, its light efficiency, lifetime, or the like has been considered, but a characteristic of its orientation angle has not been considered.

However, a demand for LED lamps having characteristics of orientation angle and light distribution similar to those of conventional incandescent lamps has recently increased.

Lens type, reflector type, and vertical type LED lamps have been developed so that their characteristics of orientation angle and light distribution are similar to those of the conventional incandescent lamps.

However, a reflector type LED lamp may radiate light to a rear portion of an LED that is a light emitting source, but have a relatively low light efficiency. A lens type LED lamp may be superior to the reflector type LED lamp in terms of light control and light efficiency, but may have a technical difficulty in implementing a characteristic of an orientation angle of light. Particularly, there it may be difficult to radiate light toward a rear portion of an LED.

Meanwhile, a vertical type LED lamp emits light in a sideward direction by disposing an upper portion of an LED in a vertical direction, thereby acting as a conventional lightbulb. Therefore, the vertical type LED lamp may have an excellent light distribution curve, but may have difficulty in controlling the LED to emit light uniformly in all directions. In addition, since it may be necessary to partition a substrate having the LED mounted thereon, it may be difficult to ensure operability of the LED, and also may increase manufacturing cost.

SUMMARY OF THE INVENTION

Exemplary embodiments of the present invention provide an LED lamp in which LEDs are respectively mounted on top and bottom surfaces of a substrate so that light can be radiated in a forward direction as well as a rearward direction of the substrate, thereby obtaining a characteristic of light distribution similar to that of an incandescent lamp.

Exemplary embodiments of the present invention also provide an LED lamp in which a reflection surface is formed by partially changing the shape of a heat sink, and an LED is mounted on a bottom surface of a substrate, so that light propagating in a rearward direction of the substrate may be reflected by the reflection surface, thereby expanding an orientation angle of the light.

Exemplary embodiments of the present invention also provide an LED lamp in which a heat sink is provided with a dissipation pin and an air flow path, which is in communication with the outside, so that heat generated from an LED can be effectively dissipated due to the flow of air.

Additional features of the invention will be set forth in the description which follows, and in part will be apparent from the description, or may be learned by practice of the invention.

An exemplary embodiment of the present invention discloses an LED lamp including a substrate, a first LED arranged on a first surface of the substrate, a second LED arranged on a second surface of the substrate, the second surface being an opposite side of the substrate from the first surface, a heat sink having a mounting surface, the substrate being arranged on the mounting surface, a transparent cover covering the substrate, the first LED, and the second LED, wherein the heat sink further comprises a reflection surface.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
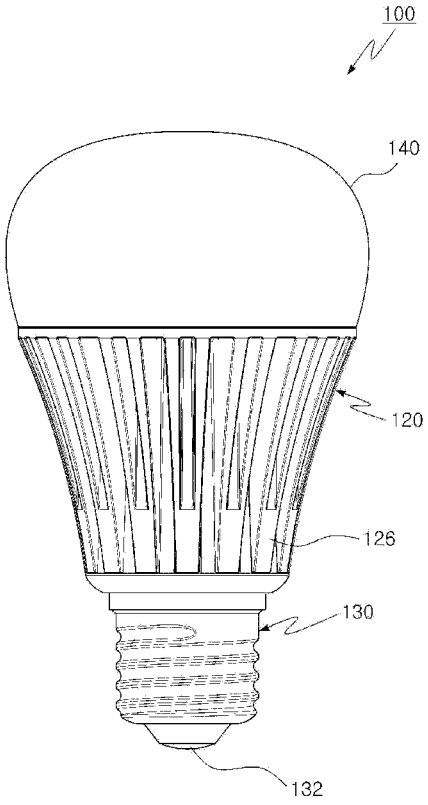
FIG. 1 is an entire assembled view of an LED lamp according to an exemplary embodiment of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element is referred to as being "directly on" or "directly connected to" another element or layer, there are no intervening elements or layers present.

Figure 2:
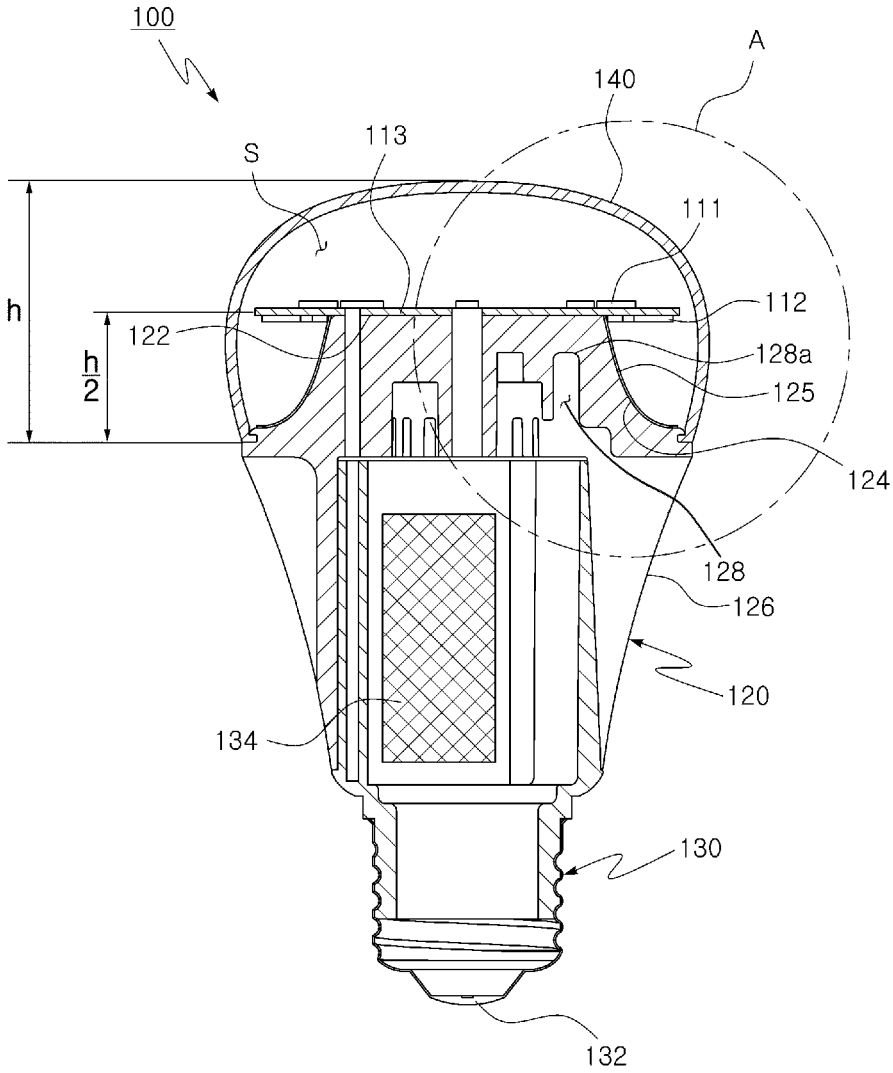
FIG. 2 is a sectional view of the LED lamp shown in FIG. 1.

Referring to FIGS. 1 and 2, an LED lamp 100 according to an exemplary embodiment of the present invention includes a light emitting source, a heat sink 120, a base portion 130 and a transparent cover 140. The light emitting source includes LEDs 111 and 112 respectively mounted on top and bottom surfaces of a substrate 113. As such, the LEDs 111 and 112 are respectively mounted on the top surface facing in a forward direction of the substrate 113 and the bottom surface facing in a rearward direction of the substrate 113, so that the LED lamp 100 can radiate light not only in a forward direction but also in a rearward direction. The LED lamp 100 is configured so that when power is applied to the LED lamp 100, the LEDs 111 and 112 may be operated by receiving the power supplied through a circuit or wire of the substrate 113 and radiate light to an outside of the LED lamp 100.

For convenience of illustration, the LED mounted on the top surface of the substrate 113 is referred to as a first LED 111, and the LED mounted on the bottom surface of the substrate 113 is referred to as a second LED 112.

Figure 3:
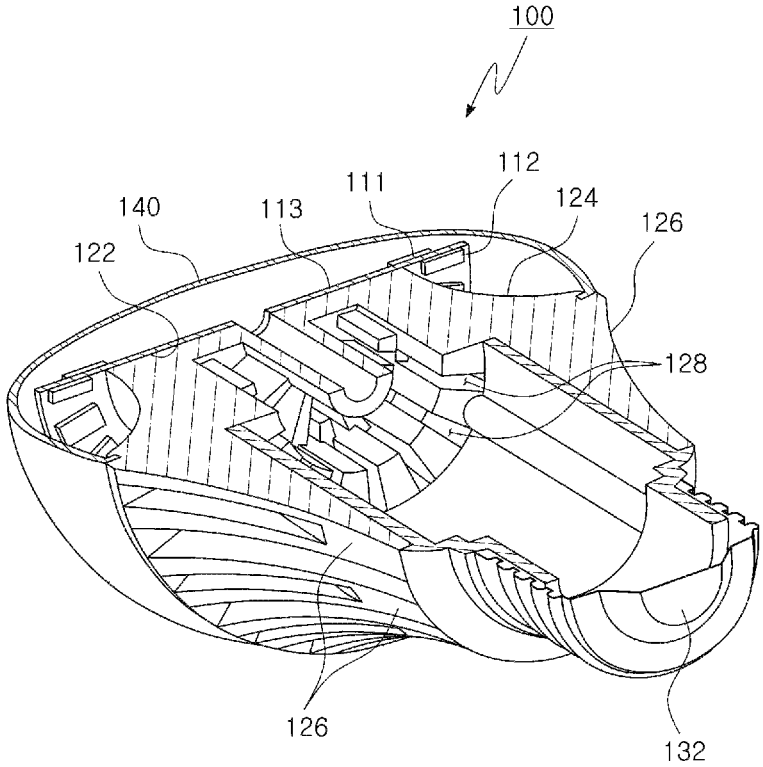
FIG. 3 is a bottom perspective view of the LED lamp of FIG. 1 wherein a portion of the LED lamp is cut away.

As well shown in FIGS. 2 and 3, the first LED 111 is mounted on the top surface of the substrate 113 so as to emit light forward, i.e., in an upward direction of the LED lamp 100 shown in FIG. 2, and the second LED 112 is mounted on the bottom surface of the substrate 113 so as to emit light rearward and sideward, i.e., in downward and sideward directions of the LED lamp 100 shown in FIG. 2.

As described above, in the LED lamp 100 according to the present exemplary embodiment, the first and second LEDs 111 and 112 are mounted on the top and bottom surfaces of the substrate 113, respectively, so as to divide up a light emitting region of light radiated to the outside. Thus, the limitation of a conventional LED showing a "straight" light distribution characteristic may be overcome so that a characteristic of light distribution similar to that of an incandescent lamp may be obtained.

Here, each of the first and second LEDs 111 and 112 may be provided with a chip-on-board (COB)-type LED device in which a plurality of LED chips are integrated on a printed circuit board so as to form a light emitting chip, a package-type LED device having a lead frame, or a combination thereof. Light emitted from the first and second LEDs 111 and 112 may be one or more of red, blue, and green lights, or a white light.

The substrate 113 is a component on which the first and second LEDs 111 and 112 are mounted as light-emitting sources. The substrate 113 may be a printed circuit board having a pattern circuit previously set to be electrically connected to an external power source for supplying power to the substrate 113 through a power cable (not shown) and to be electrically connected to the light-emitting sources.

The substrate 113 is mounted on a mounting surface 122 formed on a top surface of the heat sink 120. The substrate 113 is configured to have an area greater than that of the mounting surface 122 so that an outermost edge of the substrate 113 protrudes outward from the mounting surface 122. When the substrate 113 is mounted on the mounting surface 122, the center of the substrate 113 may correspond to that of the heat sink 120. Since the edge of the substrate 113 protrudes outward from the mounting surface 122, a region on which the second LEDs mounted is provided along a bottom circumference of the mounting surface 122, on the bottom surface of the substrate 113.

Here, the substrate 113 may be formed in the shape of a circular disk or a polygonal plate such as a triangular or quadrilateral shape.

The substrate 113 may be connected to the heat sink by a fastening member (not shown) as described above, so that it may be removed or replaced. Alternatively, a heat dissipation pad (not shown) having an adhesive property may be disposed on the mounting surface 122 so that the substrate 113 may be adhered to the mounting surface 122 by the heat dissipation pad.

The heat sink 120 is coupled with the base portion 130 so as to form the entire external appearance of the LED lamp 100, and the heat sink 120 serves to dissipate heat generated during light emission of the light-emitting sources to the outside. The heat sink 120 may be made of a metal having an excellent thermal conductivity such as aluminum so as to effectively dissipate the heat generated in light emission of the light-emitting sources, and the heat sink 120 may be provided with a plurality of heat dissipation pins 126 along a circumferential direction on an outer surface of the heat sink 120 so as to increase the heat dissipation efficiency by increasing a heat dissipation area.

In addition, as shown in FIGS. 2 and 3, the LED lamp 100 may be provided with an air flow path 128 formed to be recessed into the heat sink 120 to a predetermined depth from the outer surface of the heat sink 120, so that relatively cold external air may be introduced into the heat sink 120 to implement heat dissipation by convection.

In the air flow path 128, a sealed uppermost end 128*a* extends up to a lower side of the mounting surface 122 so as to allow the cold air to reach the vicinity of the bottom surface of the substrate 113 that may have a relatively high temperature, so that the heat generated from the light-emitting sources may be quickly dissipated outward.

The heat sink 120 may be provided with only one of the heat dissipation pin 126 and the air flow path 128. However, the heat sink 120 may be provided with both the heat dissipation pin 126 and the air flow path 128 so as to maximize the heat dissipation efficiency.

When the heat sink 120 is provided with both the heat dissipation pin 126 and the air flow path 128, a plurality of heat dissipation pins 126 may be formed along the circumferential direction on the outer surface of the heat sink 120 to be spaced apart from one another at a predetermined interval, and each air flow path 128 may be formed between two adjacent heat dissipation pins 126, so that the whole heat sink 120 may be uniformly cooled.

The heat sink 120 has the flat mounting surface 122 on the top surface thereof so that the substrate 113 may be mounted thereto, and a lower side of the heat sink 120 is coupled with the base portion 130.

The heat sink 120 is coupled with the transparent cover 140. The transparent cover has a height h. The mounting surface 122 is positioned to extend upward by a predetermined height from a bottom end coupling position of the transparent cover 140 (i.e., where a distal end of the transparent cover 140 contacts the heat sink 120), so that the mounting surface 122 is disposed at height h/2 of the transparent cover 140. Accordingly, the first and second LEDs 111 and 112 respectively mounted on the top and bottom surfaces of the substrate 113 are also disposed at height h/2 of the transparent cover 140, so that the light generated from the first LED 111 is radiated to the outside through an upper region of the transparent cover 140 while the light generated from the second LED 112 is radiated to the outside through a lower region of the transparent cover 140.

The heat sink 120 is provided with a reflection surface 124 so that the light, which is generated from the second LED 112 and propagates toward the heat sink 120, may be directed or reflected toward the transparent cover 140. According to the present exemplary embodiment, a surface extends toward an outskirt of the mounting surface 122 at the same height as the mounting surface 122, and the extending surface and the mounting surface 122 constitute a virtual top surface of the heat sink 120, the reflection surface 124 being formed at a lower side of the outermost edge of the mounting surface 122 by the shape in which an outer region of the mounting surface 122 is cut away toward the lower side with respect to the virtual top surface as shown in FIG. 2.

The reflection surface 124 which performs a function for reflecting a portion of the light generated from the second LED 112 toward the transparent cover 140 may include at least one reflection layer 125 so as to increase the reflectance. The reflection layer 125 may be formed of a reflective material having a relatively higher reflectance for light such as aluminum or chrome using various methods including deposition, anodizing, plating, and the like. A metal surface of the heat sink 120 may be subjected to, for example, specular treatment to be used as the reflection surface 124 without the reflection layer 125. A reflection sheet or film, or a reflector may be attached to the cut-away surface of the heat sink 120, thereby forming the reflection surface 124.

Figure 5:
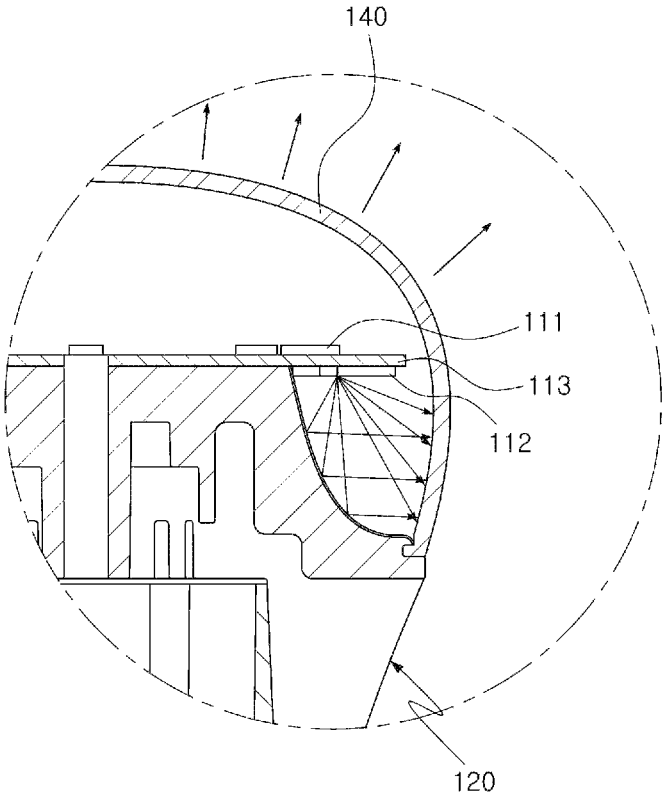
FIG. 5 is a view conceptually showing a state in which light from first and second LEDs shown in FIGS. 1 to 4 is radiated to an outside of the LED lamp.

A portion of the light generated from the second LED 112 directly propagates toward the transparent cover 140, and the other of the light generated from the second LED 112 propagates toward the heat sink 120. The reflection surface 124, which extends by passing the edge of the mounting surface 122, covers the second LED 112 at the lower side of the mounting surface 122, so that the reflection surface 124 can cause the light which propagates toward the heat sink 120 to be reflected toward the transparent cover 140 (see FIG. 5).

As such, the reflection surface 124 covering the lower side of the second LED 112 causes a portion of the light generated from the second LED 112 to be reflected toward the transparent cover 140, so that it is possible to expand the orientation angle of the LED lamp 100 and to obtain a characteristic of light distribution similar to that of an incandescent lamp.

Figure 4:
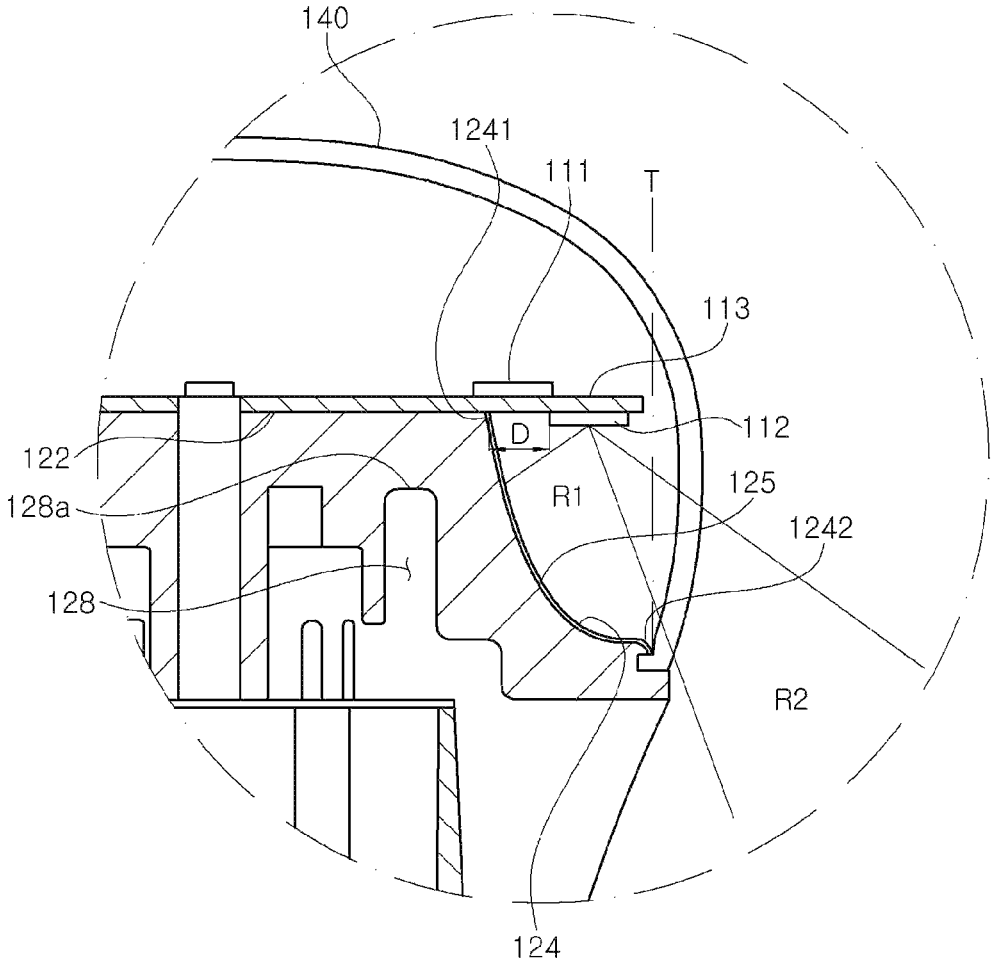
FIG. 4 is an enlarged sectional view of the LED lamp shown in FIG. 2, wherein a circular portion A of FIG. 2 is enlarged.

As shown in FIG. 4, the reflection surface 124 is formed to extend from a top end or start end 1241 of the reflection surface 124 corresponding to the edge of the mounting surface 122 to a bottom end or finish end 1242 corresponding to or adjacent to the bottom end of the transparent cover 140. The reflection surface 124 is formed as an inclined curved surface on which a horizontal distance of the reflection surface 124 with respect to the finish end 1242 is consecutively decreased from the start end 1241 to the finish end 1242. Here, the "horizontal distance" refers to a shortest distance from an arbitrary point on the reflection surface 124 to a virtual vertical line T vertically passing the finish end 1242. At this time, the reflection surface 124 is formed as a curved surface concavely recessed from a straight line with which the start end 1241 and the finish end 1242 are connected to each other, and the slope at an upper portion of the curved surface is greater than that at a lower portion of the curved surface.

The light emitting region of the second LED 112 is divided into a reflection region R1, to which the reflection surface 124 is applied, and a non-reflection region R2, to which the reflection surface 124 is not applied so that the light is directly radiated through the transparent cover 140. When the reflection surface 124 is fixed, the ratio of the non-reflection region R2 to the reflection region R1 can be controlled by adjusting a horizontal spacing distance (i.e., a shortest spacing distance) D between the second LED 112 and the reflection surface 124.

In the present exemplary embodiment, the horizontal spacing distance D between the second LED 112 and the reflection surface 124 is configured to be relatively large so as to enlarge the ratio of the non-reflection region R2 to increase the intensity of light in the rearward direction. More specifically, the distance between the second LED 112 and the start end 1241 of the reflection surface 124, i.e., the horizontal spacing distance D, is greater than the horizontal distance from the second LED 112 to the finish end 1242 of the reflection surface 124. Further, the horizontal spacing distance D between the second LED 112 and the start end 1241 of the reflection surface 124 is greater than the distance from the second LED 112 to the edge of the substrate 113.

The transparent cover 140 may have the greatest diameter at the same height as the substrate 113 or the second LED 112 so as to be capable of securing a sufficient distance between the transparent cover 140 and the substrate 113 or the second LED 112. The transparent cover 140 may be divided into upper and lower portions based on the substrate 113. While the upper portion of the transparent cover 140 has a relatively great curvature from a position adjacent to the substrate 113 to a predetermined height, the lower portion of the transparent cover 140 includes a region in which the curvature at a portion spaced away from the substrate 113 is larger than that at a portion adjacent to the substrate 113. As such, the region of the lower portion of the transparent cover 140, which has a large curvature, is included in the non-reflection region R2 or overlapped with the non-reflection region R2.

Figure 6:
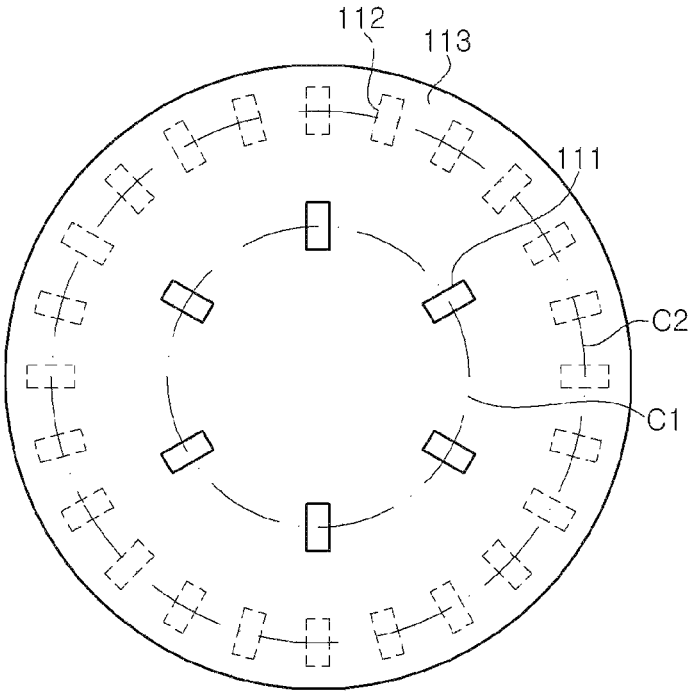
FIG. 6 is a plan view illustrating an arrangement of first LEDs on a top surface of a substrate and second LEDs on a bottom surface of the substrate.

FIG. 6 is a plan view of the substrate 113 having the first and second LEDs 111 and 112 mounted thereon, shown from the top surface of the substrate 113 on which the first LEDs 111 are mounted. In FIG. 6, the second LED 112 is indicated by a dotted line.

Referring to FIG. 6, five first LEDs 111 are arranged in a circular form in the middle between the center of the disk-shaped substrate 113 and the edge thereof on the top surface of the substrate 113. The distances from the center of the substrate 113 to all the first LEDs 111 are substantially identical to one another. In addition, 23 second LEDs 112 are positioned around an outskirt of the bottom surface of the substrate 113 to be adjacent to the edge of the substrate 113 on the bottom surface of the substrate 113. The second LEDs 112 are arranged in a circular form along the circular edge of the substrate 113.

The number of each of the first and second LEDs 111 and 112 may be variously changed. However, the number of the second LEDs 112 is preferably greater than that of the first LEDs 111. More preferably, the number of the LEDs 112 is more than two times greater than that of the first LEDs 111.

A virtual second circle C2 obtained by connecting the centers of the second LEDs 112 to one another has the same center as a virtual first circle C1 obtained by connecting the centers of the first LEDs 111 to one another. The diameter of the virtual second circle C2 is greater than that of the virtual first circle C1. Accordingly, all the first LEDs 111 are positioned inside the arrangement of the second LEDs 112. The distance between the second circle C2 and the first circle C1 is preferably more than two times greater than that between the second circle C2 and the edge of the substrate 113.

The arrangement and/or number of the first and second LEDs 111 and 112 together with the structure of the reflection surface becomes an important factor for determining the characteristic of light distribution of the LED lamp 100.

Figure 7:
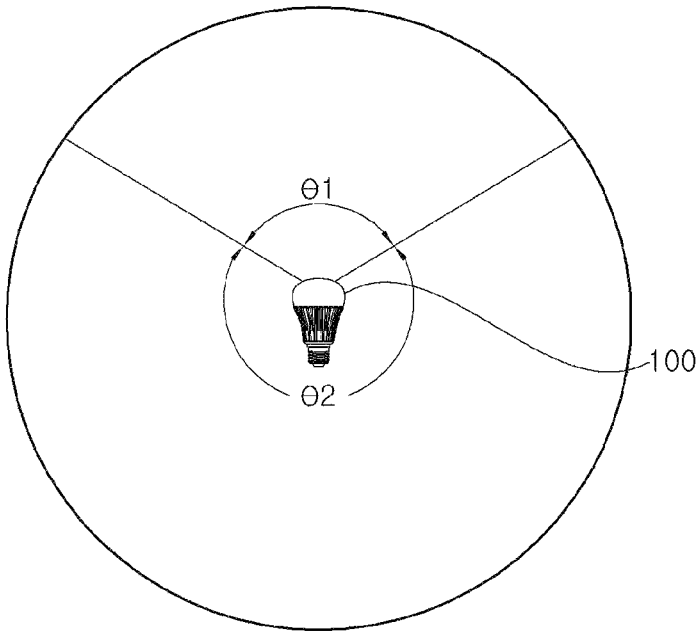
FIG. 7 is a view illustrating a light distribution of the LED lamp shown in FIGS. 1 to 5.

As shown in FIG. 7, the light distribution region of the LED lamp 100 includes a region of a first light distribution angle θ1, in which the first LEDs 111 (see FIGS. 2 to 6) are superior to the second LEDs 112, and a region of a second light distribution angle θ2, in which the second LEDs 112 (see FIGS. 2 to 6) are superior to the first LEDs 111. According to the configuration of the LED lamp 100 described above, the first light distribution angle θ1 is smaller than the second light distribution angle θ2. The first light distribution angle θ1 is preferably 120 degrees and the second light distribution angle θ2 is 240 degrees.

Referring back to FIGS. 2 to 4, the base portion 130 for supplying a power to the LED lamp 100 from the outside is coupled to a lower portion of the heat sink 120. A power supply portion 134 is built in the base portion 130 so as to supply the power to the substrate 113, and a socket-type connection portion 132 is provided at a bottom end of the base portion 132 so as to receive the power applied from the outside and to supply the received power to the power supply portion 134. The connection portion 132 is manufactured to have the same shape as a socket of a conventionally used incandescent lamp so as to substitute for the incandescent lamp.

The bottom end of the transparent cover 140 is coupled with an upper outer edge of the heat sink 120 so as to protect the first and second LEDs 111 and 112 from an external environment and to radiate light generated during the light emission to the outside. The transparent cover 140 has a space portion S in the inside thereof. The transparent cover 140 preferably has a light diffusion function so that the light generated from the first and second LEDs 111 and 112 can be diffused and radiated to the outside.

As described above, the bottom end of the transparent cover 140, coupled with the heat sink 120, is configured to be coupled with the bottom end or finish end 1242 of the reflection surface 124, so that all the light reflected through the reflection surface 124 can be radiated to the outside through the transparent cover 140.

In addition to the shape shown in these figures, the transparent cover 140 may have various shapes including a parabolic shape having different curvatures, a polygonal shape, and the like.

Although it has been illustrated in these figures that an open bottom end of the transparent cover 140 is latched to the heat sink 120, the present invention is not limited thereto. It will be apparent that various coupling methods, such as a screw coupling method and a tight fitting coupling method, may be used to couple the transparent cover 140 with the heat sink 120.

Figure 8:
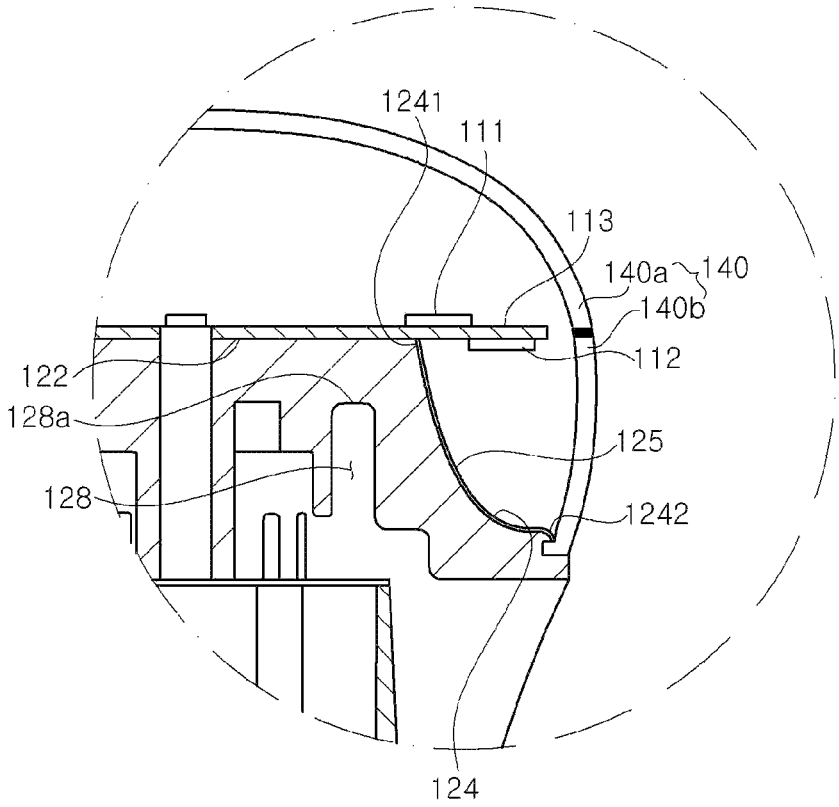
FIGS. 8 and 9 are views illustrating exemplary embodiments of a transparent cover in an LED lamp according to the present invention.
Figure 9:
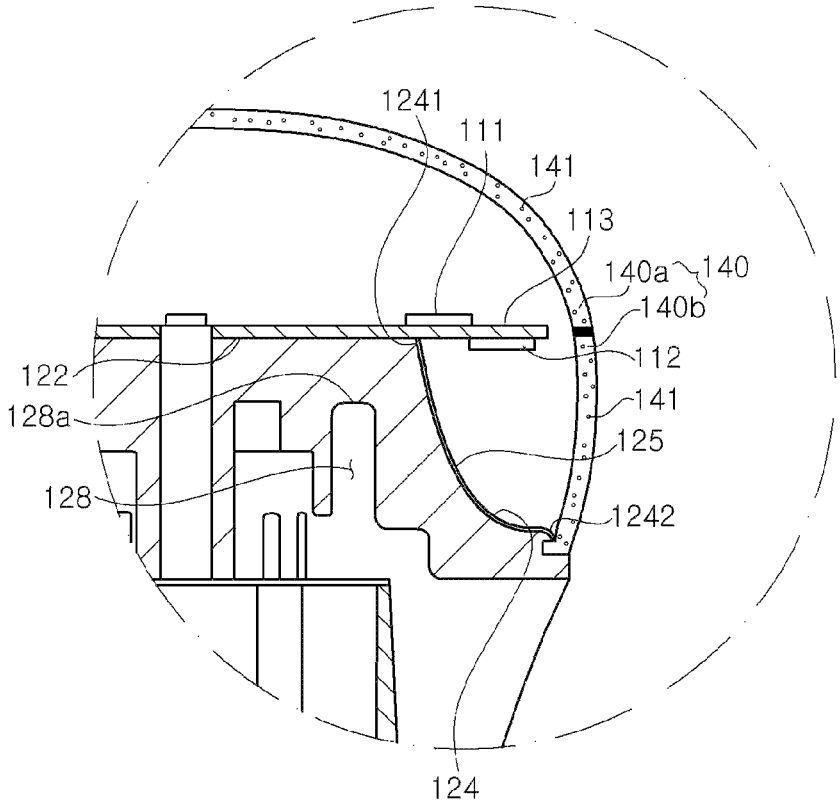

FIGS. 8 and 9 are enlarged sectional views illustrating other exemplary embodiments of the transparent cover.

Referring to FIG. 8, the transparent cover 140 includes an upper portion 140*a* and a lower portion 140*b* which are coupled to each other. The upper and lower portions 140*a* and 140*b* of the transparent cover 140 are separately formed and then coupled to each other. Adhesion, fastening, or engagement methods may be used to couple the upper and lower portions 140*a* and 140*b* to each other. A boundary between the upper and lower portions 140*a* and 140*b* is defined to be positioned at or around the same height h/2 as the substrate 113, at which the light hardly reaches. Accordingly, the distortion of the characteristic of light distribution, which might be caused by the transmission of light, may be minimized by means of the boundary between the upper and lower portions 140*a* and 140*b*.

Optical characteristics of the upper and lower portions 140*a* and 140*b* of the transparent cover 140 may be different from each other. For example, the light transmittance of the upper portion 140*a* may be set to be higher than that of the lower portion 140*b*, and the light diffusivity of the upper portion 140*a* may be set to be lower than that of the lower portion 140*b*, so that it is possible to increase an amount of light in the forward direction and to widely distribute light in the rearward and sideward directions.

Referring to FIG. 9, the transparent cover 140 includes a phosphor 141 serving as a remote phosphor. The phosphor 141 may be dispersed in the transparent cover 140 by being mixed in a resin constituting the transparent cover 140 when the transparent cover 140 is formed. Alternatively, the phosphor 141 may be formed as a layered phosphor on an inner or outer surface of the transparent cover 140. In the present exemplary embodiment, the same kind of phosphor with the approximately same dispersion is applied to the upper and lower portions 140*a* and 140*b* of the transparent cover 140. However, the kinds or dispersions of the phosphors applied to the upper and lower portions 140*a* and 140*b* may be different from each other. Furthermore, it may be considered that the phosphor is applied to only any one of the upper and lower portions 140*a* and 140*b* of the transparent cover 140. In the present exemplary embodiment, the phosphor 141 has been applied to the transparent cover 140 in which the upper and lower portions 140*a* and 140*b* thereof are coupled to each other. However, it will be apparent that the phosphor may be also applied to the transparent cover 140 in which the upper and lower portions thereof are integrally formed. In the present exemplary embodiment, the phosphor 141 has been used to change the color temperature of light emitted from the LED lamp 100.

Figure 10:
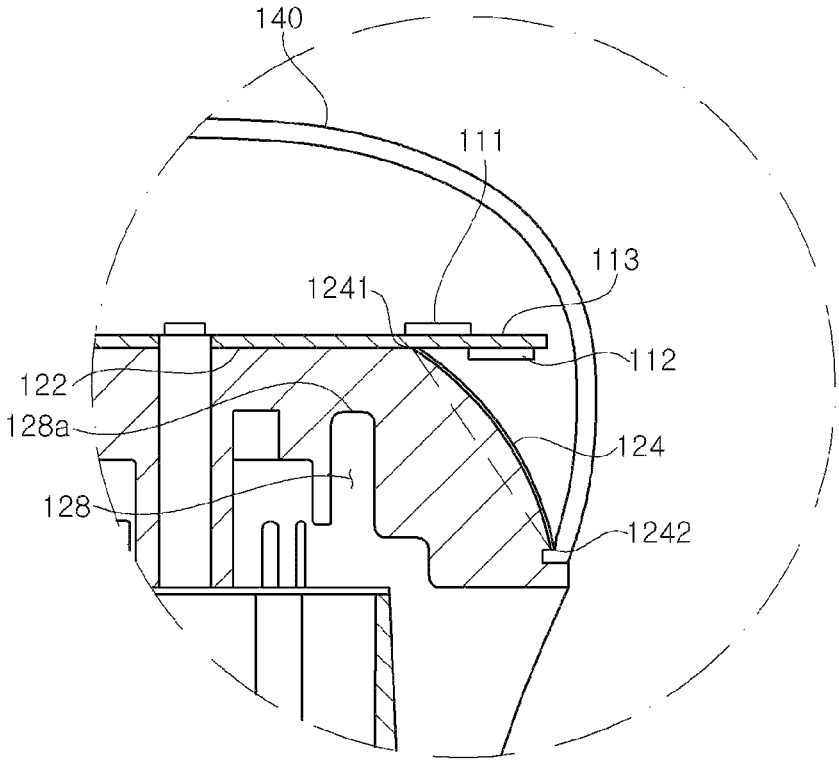
FIG. 10 is an enlarged sectional view illustrating an LED lamp having a convex reflection surface according to an exemplary embodiment of the present invention.

FIG. 10 is an enlarged sectional view illustrating an LED lamp 100 having a convex reflection surface according to an exemplary embodiment of the present invention. FIGS. 11*a* and 11*b* are views illustrating a difference between an LED lamp 100 having a concave reflection surface and an LED lamp 100 having a convex reflection surface.

In the previous exemplary embodiment, the structure of the reflection surface 124 has been mainly described, in which the concave reflection surface is used as the reflection surface 124 for reflecting the light generated from the second LEDs 112 on the bottom surface of the substrate 113. The concave reflection surface as described in the previous exemplary embodiment increases the light flux of the light emitted from the second LED 112 on the bottom surface of the substrate 113.

Referring to FIG. 10, an LED lamp may be shown in which an entirely convex reflection surface 124 is applied between the start end 1241 and the finish end 1242 of the reflection surface 124. The reflection surface 124 is further protruded with respect to a straight line with which the start and finish ends 1241 and 1242 of the reflection surface 124 are connected to each other. The convex reflection surface 124 may be useful when it is required to decrease the light flux in the rearward and sideward directions of the LED lamp 100.

The characteristic of light distribution may be considerably changed depending on the shape of the reflection surface 124, which results from the fact in which the position of a region having a relatively highest light flux (hereinafter, referred to as a "maximum light flux region") is changed according to the shape of the reflection surface 124.

Figure 11:
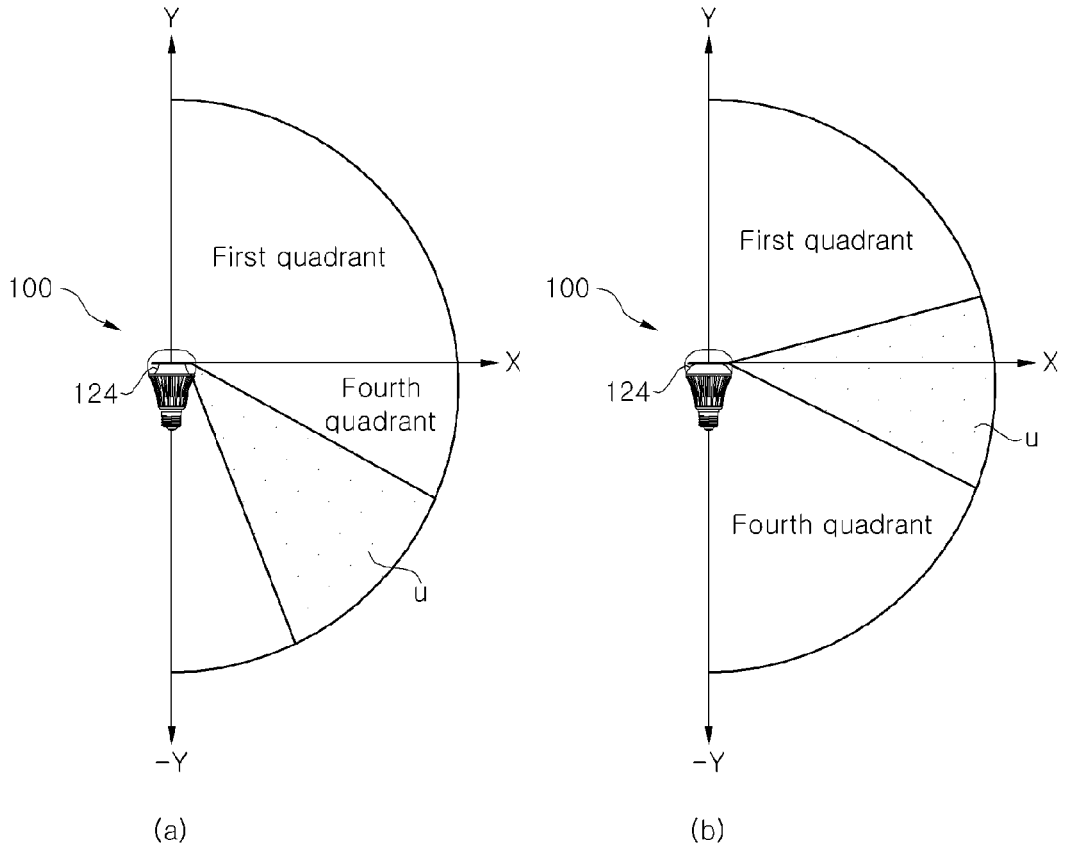
FIGS. 11(*a*) and (*b*) are views illustrating a difference between an LED lamp having a concave reflection surface and an LED lamp having a convex reflection surface.

FIG. 11(*a*) is a view showing on an X-Y coordinate the maximum light flux region which may be obtained by the second LEDs 112 in the LED lamp 100 in which the entire reflection surface 124 is a concave surface. Meanwhile, FIG. 11(*b*) is a view showing on an X-Y coordinate the maximum light flux region which may be obtained by the second LEDs 112 in the LED lamp 100 in which the entire reflection surface 124 is a convex surface.

In FIGS. 11(*a*) and (*b*), the Y-axis vertically passes the center of the LED lamp 100 while the X-axis is perpendicular to the Y-axis and horizontally passes the light emitting source of the LED lamp 100. The X-axis and Y-axis cause a second-dimensional plane to be divided into four quadrants, i.e., first, second, third, and fourth quadrants. For convenience of illustration, only the first and fourth quadrants are shown in FIGS. 11(*a*) and (*b*).

In the LED lamp 100 in which the entire reflection surface 124 is formed as a single concave surface, the maximum light flux region u due to the second LEDs 112 is included only in the fourth quadrant below X-axis as shown in FIG. 11*a*. This means that a large amount of light is distributed in the rearward direction of the LED lamp 100. In the LED lamp 100 in which the entire reflection surface 124 is formed as a single convex surface, the maximum light flux region u due to the second LEDs 112 exists in the first and fourth quadrants adjacent to the X-axis as shown in FIG. 11(*b*). This means that a large amount of light is distributed in the sideward direction of the LED lamp 100.

When the reflection surface 124 having the single concave surface is used, as a concave degree of the single concave surface is increased, a large amount of light is distributed in the fourth quadrant below the X-axis. When the reflection surface 124 having the single convex surface is used, as a convex degree of the single convex surface is increased, a large amount of light is distributed in the sideward direction of the LED lamp 100.

Figure 12:
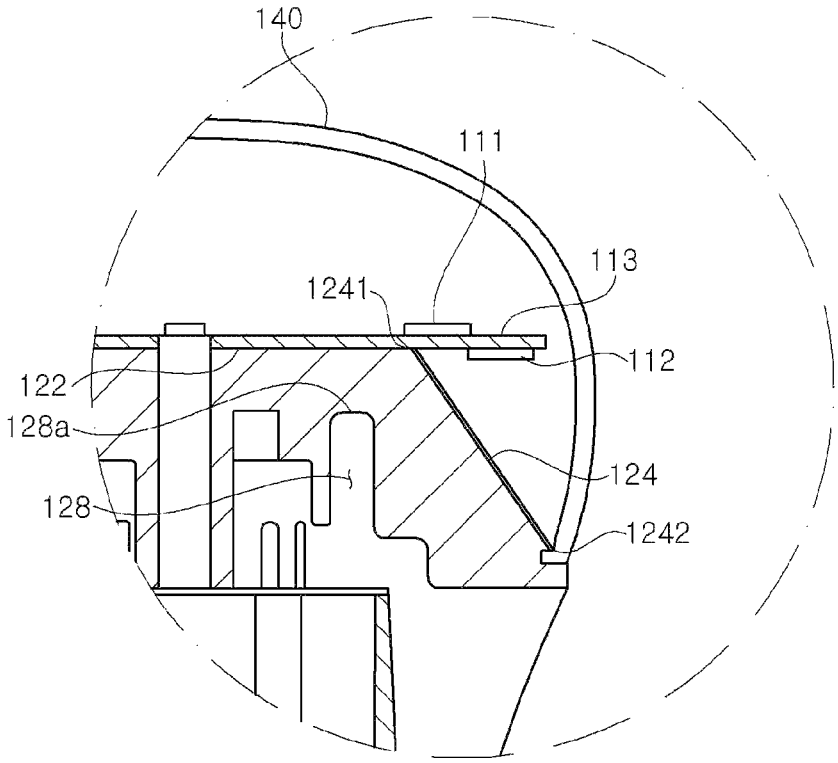
FIG. 12 is a view illustrating an LED lamp having a reflection surface formed as a straight inclined surface.

The LED lamp 100 according to the present exemplary embodiment may include a straight reflection surface rather than the curved reflection surface, which is shown in FIG. 12. Referring to FIG. 12, an LED lamp 100 is shown in which a straight surface with which the start and finish ends 1241 and 1242 are connected to each other constitutes the reflection surface 124. When the reflection surface 124 is formed as a single straight surface as shown in FIG. 12, the light distribution of the LED lamp 100 may be controlled to a certain degree by adjusting the slope or gradient of the straight surface. The straight surface may be partially applied to the reflection surface 124 including a curved surface so that the straight surface may contribute to controlling the characteristic of light distribution of the LED lamp 100.

Figure 13:
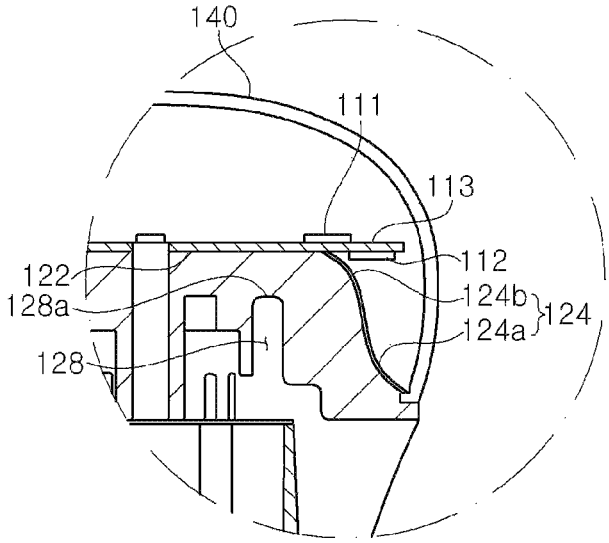
FIGS. 13(*a*) and (*b*) are views illustrating LED lamps each having a reflection surface including both concave and convex surfaces.
Figure 13:
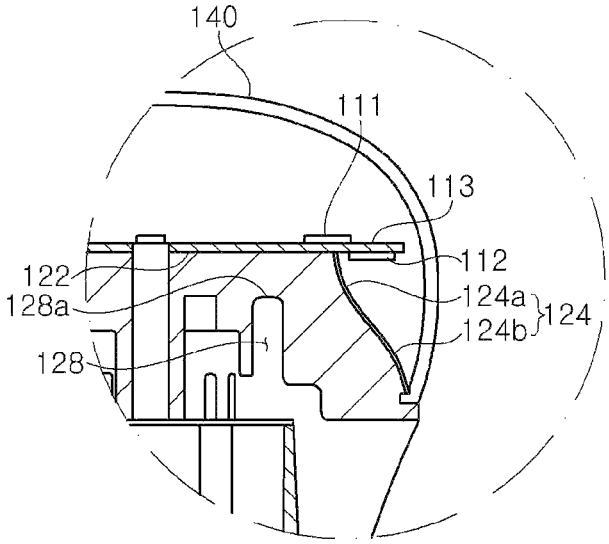

Referring to FIGS. 13(*a*) and (*b*), an LED lamp 100 is shown, to which the reflection surface 124 including both concave and convex portion 124*a* and 124*b* is applied. As shown in FIG. 13(*a*), the reflection surface 124 is provided with the concave portion 124*a* at a lower portion of the reflection surface 124 and the convex portion 124*b* at an upper portion of the reflection surface 124. As shown in FIG. 13(*b*), the reflection surface 124 is provided with the concave portion 124*a* at an upper portion of the reflection surface 124 and the convex portion 124*b* at a lower portion of the reflection surface 124. In both the structures shown in FIGS. 13(*a*) and (*b*), the curvature of the reflection surface 124 is changed from a positive (+) curvature to a negative (−) curvature in the middle of the reflection surface 124 or vice versa, thereby forming the single reflection surface 124 including both the concave and convex portions 124*a* and 124*b*.

As described above, if the structure is used in which the curvature is changed from a positive (+) curvature to a negative (−) curvature in the middle of the reflection surface 124 or vice versa, it is possible to increase the degree of freedom of design in controlling a desired characteristic of light distribution in the rearward or sideward direction of the LED lamp 100. The sequence of the convex and concave surfaces in the reflection surface 124, the number, length, or curvature of the convex or concave surfaces in the reflection surface 124, and so on, may be considered as the factors which may be used to control the characteristic of light distribution. The straight inclined reflection surface described above as well as the concave or convex surface may be applied to the reflection surface 124, so that the degree of freedom of design in controlling the characteristic of light distribution may be increased.

Figure 14:
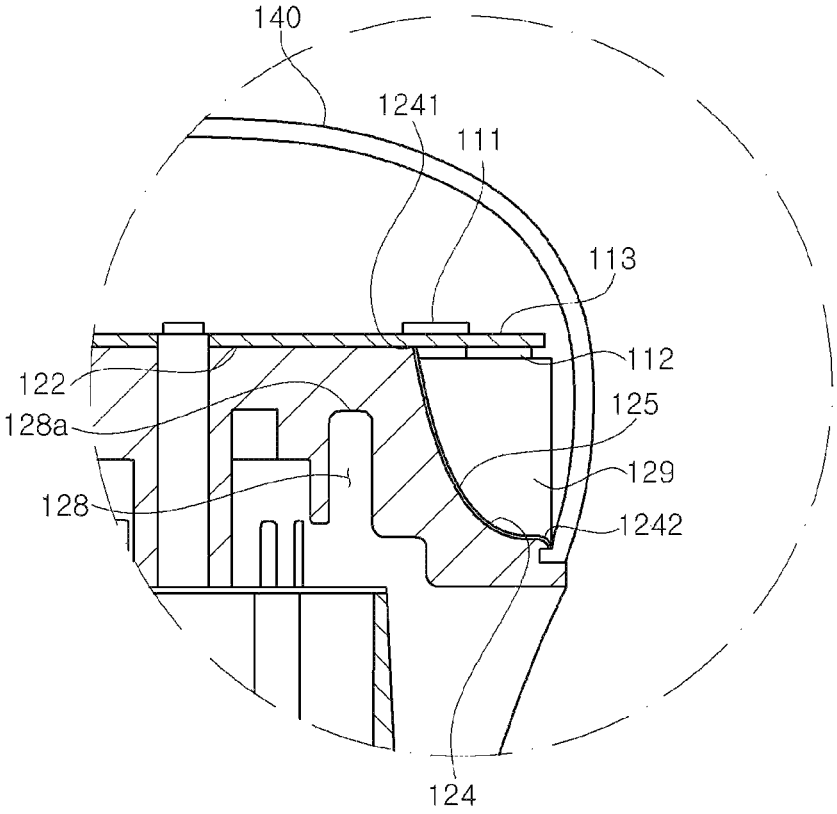
FIGS. 14 and 15 are views illustrating an LED lamp including reflecting partition portions for separating and partitioning a mounting region for second LEDs on a bottom surface of a substrate according to an exemplary embodiment of the present invention.
Figure 15:
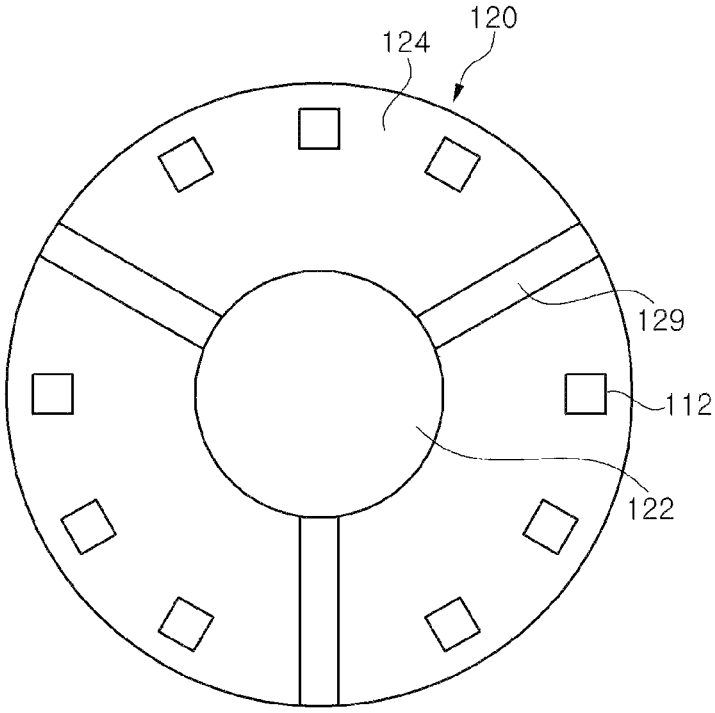

FIGS. 14 and 15 are views illustrating an LED lamp 100 including reflecting partition portions 129 for the second LEDs 112 according to an exemplary embodiment of the present invention. FIG. 14 is an enlarged sectional view of an LED lamp 100 shown in the same direction as the LED lamps of FIGS. 4, 8, 9, 10, 12 and 13. FIG. 15 is a bottom view of the LED lamp 100 shown from a bottom portion of the substrate 113 toward a top portion thereof by laterally cutting away the heat sink 120.

Referring to FIGS. 14 and 15, the LED lamp 100 according to the present exemplary embodiment further includes rib-shaped reflecting partition portions 129 formed to protrude in a radial direction from the reflection surface 124 that serves as an upper circumferential surface of the heat sink 120. The plurality of reflecting partition portions 129 divides a mounting region for the second LEDs 112 into a plurality of mounting regions. When the number of the second LEDs 112 is small, the reflecting partition portion 129 allows light reflected by the plurality of reflecting partition portions 129 to cross to one another, so that the light can be widely dispersed and radiated in the circumferential direction of the LED lamp 100.

Figure 16:
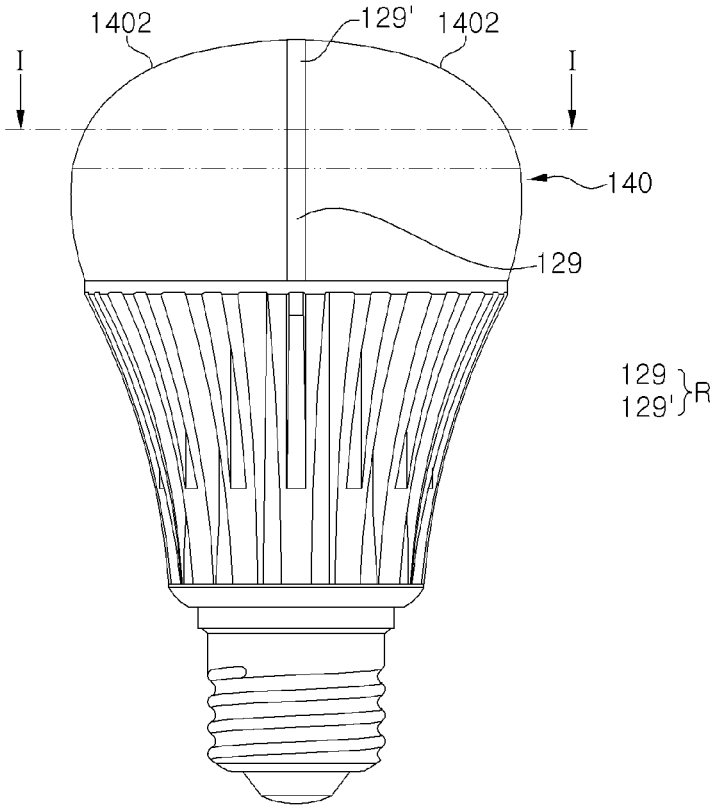
FIGS. 16 and 17 are views illustrating an LED lamp including reflecting partition portions for separating and partitioning a mounting region for first LEDs on a top surface of a substrate according to an exemplary embodiment of the present invention.
Figure 17:
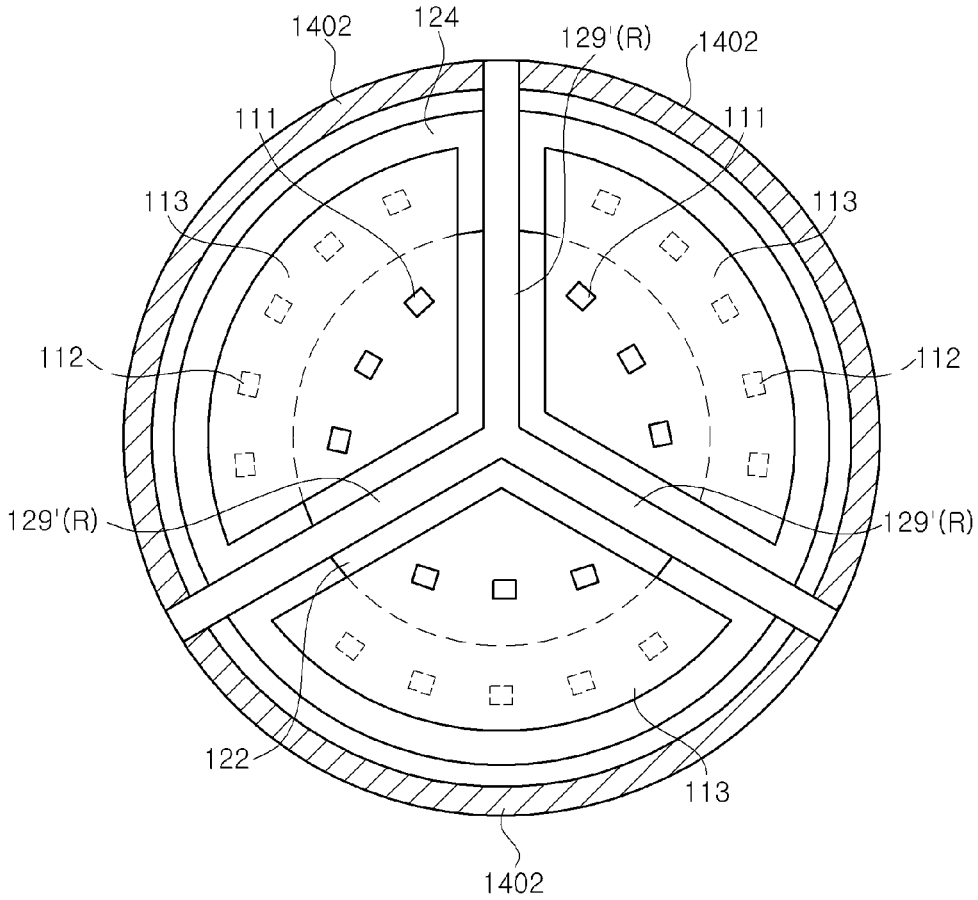

FIG. 16 is a front view showing an LED lamp 100 according to an exemplary embodiment of the present invention. FIG. 17 is a cross-sectional view taken along line I-I of FIG. 16.

Referring to FIG. 17, the LED lamp 100 according to the present exemplary embodiment includes a plurality of upper reflecting partition portions 129' for dividing a mounting region for the first LEDs 111 into a plurality of mounting regions. The plurality of upper reflecting partition portions 129' are integrally formed above the mounting surface 122, and are arranged at a predetermined angle. The upper reflecting partition portion 129' may extend in a sideward direction up to a position in which the upper reflecting partition portion 129' is in contact with the transparent cover 140, so that the upper reflecting partition portion 129' may have a corner which is shaped to correspond to a profile of the transparent cover 140. An upper region of the mounting surface 122 is divided into a plurality of regions by the plurality of upper reflecting partition portions 129', the substrate 113 is divided into a plurality of fan-shaped substrates 113, and a fan-shaped substrate 113 is mounted in each of the plurality of regions of the upper region of the mounting surface 122. At least one first LED 111 is mounted at a middle portion on the top surface of each fan-shaped substrate 113, and at least one second LED 112 is mounted around an edge of the bottom surface of each fan-shaped substrate 113. Similarly to the above exemplary embodiments, the heat sink 120 includes the reflection surface 124 formed on a lower outer circumferential surface of the mounting surface 122.

The LED lamp 100 may further include reflecting partition portions 129 (see FIGS. 14 and 15, hereinafter, referred to as "lower reflecting partition portions") which separate and divide the mounting region for the second LEDs 112. The upper reflecting partition portion 129' and the lower reflecting partition portion 129 (see FIGS. 14 and 15) may be connected to extend to each other in the shape of a straight line in the mounting surface 122. The lower reflecting partition portion 129 may also extend in the sideward direction up to a position in which the lower reflecting partition portion 129 is in contact with the transparent cover 140, so that the lower reflecting partition portion 129 may have a corner which is shaped to correspond to the profile of the transparent cover 140.

Referring to FIGS. 16 and 17, the upper and lower reflecting partition portions 129' and 129 vertically connected to each other constitute a cover support rib R. A plurality of cover support ribs R radially extend above the heat sink. The transparent cover 140 is composed of a plurality of transparent cover pieces 1402, and each of the plurality of transparent cover pieces 1402 is laterally inserted into a gap between two adjacent cover support ribs R and R of the heat sink so that both side ends of each transparent cover piece 1402 may come into contact with the two adjacent cover support ribs R and R of the heat sink, respectively. In FIG. 17, the reference numeral R designating the cover support rib is represented to be enclosed with parentheses next to the reference numeral 129' designating the upper reflecting partition portion. In FIG. 16, the mounting surface 122 on which the substrate 113 is mounted is indicated by a two-dot chain line so as to distinguish the two portions constituting the cover support rib R, i.e., the upper and lower reflecting partition portions 129' and 129, from each other.

Each cover support rib R may include the upper and lower reflecting partition portions 129' and 129. Alternatively, only the upper reflecting partition portion 129' without the lower reflecting partition portion 129 may be used as the cover support rib R. If the structure is used in which each of the plurality of transparent cover pieces 1402 is laterally inserted into the corresponding gap between the two adjacent cover support ribs R and R so that the plurality of transparent cover pieces 1402 may constitute the transparent cover 140, the substrate 113 may further extend toward the outer direction thereof rather than using the single transparent cover 140 as described above, and thus it can be designed that the second LEDs 112 mounted on the bottom surface of the substrate 113 are positioned to be further spaced away from the reflection surface 124.

The structure in which the integrated single transparent cover 140 is coupled with the heat sink 120 in a vertical direction as described in the above exemplary embodiments has a limitation in designing the substrate 113 so as to extend in the outer direction thereof, due to a problem in that the bottom end of the transparent cover 140 interferes with the substrate 113. If the structure is employed in which each of the plurality of transparent cover pieces 1402 is laterally inserted into the gap between the two adjacent cover support ribs R and R, it is possible to solve the interference problem of the bottom end of each of the transparent cover pieces 1402 with the substrate 113 when the transparent cover pieces 1402 are coupled to one another. As such, the substrate 113 may further extend lengthwise in the outer direction thereof.

Figure 18:
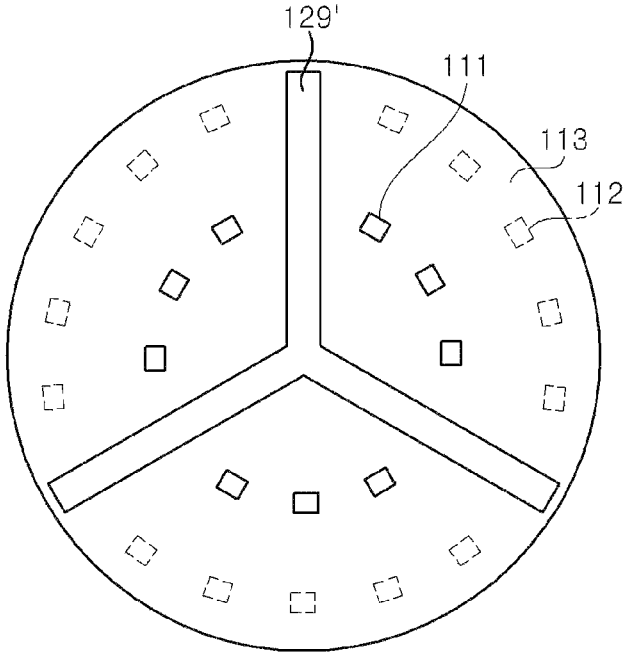
FIG. 18 is a view illustrating an LED lamp including reflecting partition portions for separating and partitioning a mounting region for first LEDs on a substrate according to an exemplary embodiment of the present invention.

FIG. 18 is a view illustrating an exemplary embodiment of the upper reflecting partition portion 129*a*, in which a plurality of upper reflecting partition portions 129' are attached on a circular single substrate 113, so that the top surface of the single substrate 113 is divided into three regions.

In the above exemplary embodiments, it has been described that package-type LED devices including lead terminals therein are used as the first and second LEDs 111 and 112.

Figure 19:
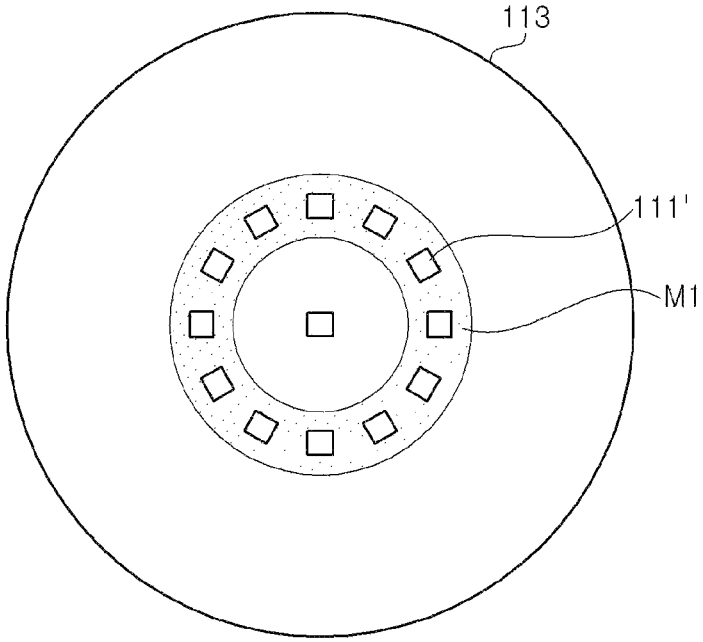
FIGS. 19(*a*) and (*b*) are views illustrating an LED lamp having first and second LEDs in which LED chips are configured to be directly mounted on top and bottom surfaces of a substrate according to an exemplary embodiment of the present invention.
Figure 19:
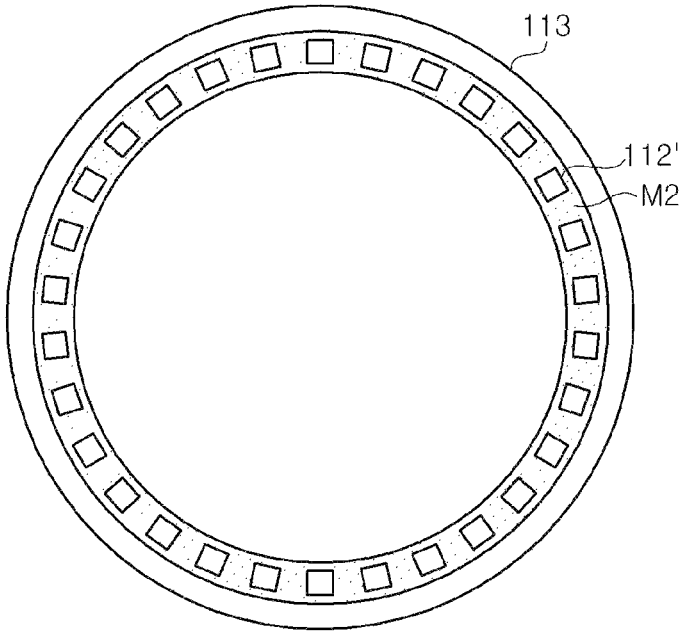

However, as shown in FIGS. 19(*a*) and (*b*), LED chips 111' and 112' directly mounted on a substrate, i.e., a printed circuit board 113, may be used as first and second LEDs.

FIG. 19(*a*) shows that the LED chips 111' directly mounted on the top surface of the substrate 113 serve as the first LEDs shown in the above exemplary embodiments. FIG. 19(*b*) shows that the LED chips 112' directly mounted on the bottom surface of the substrate 113 serve as the second LEDs shown in the above exemplary embodiments. The LED chips 111' as the first LEDs are encapsulated by a first transparent encapsulant M1 directly formed on the top surface of the substrate 113, and the LED chips 112' as the second LEDs are encapsulated by a second transparent encapsulant M2 directly formed on the bottom surface of the substrate 113. According to the present exemplary embodiment, the structure is employed in which the LED chips 111' and 112' are directly mounted on both the top and bottom surfaces of the substrate 113, respectively. However, a structure may be employed in which LED chips are directly mounted only on any one of the top and bottom surfaces of the substrate 113 and package-type LED devices are mounted on the other surface of the substrate 113.

Figure 20:
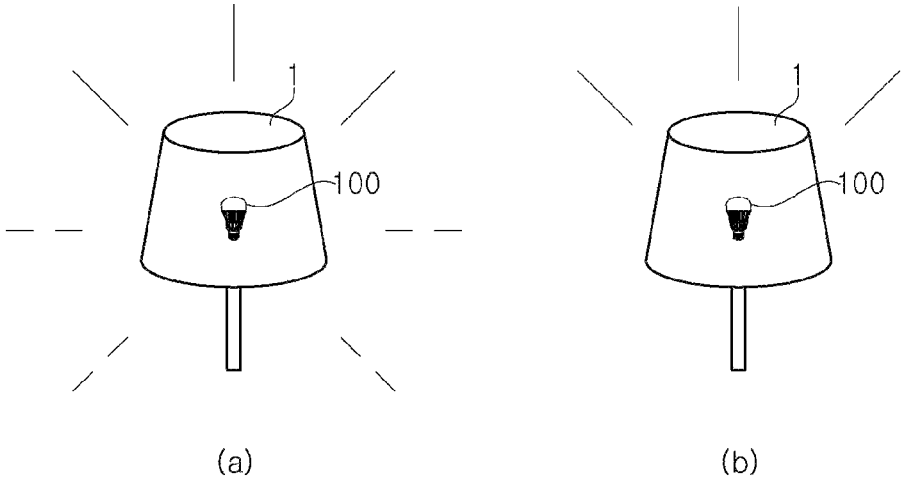
FIGS. 20(*a*) and (*b*) are views illustrating a characteristic of light distribution of a lamp appliance to which an LED lamp according to the present invention is applied and a characteristic of light distribution of a lamp appliance to which a conventional LED lamp only emitting light forward is applied.

FIGS. 20(*a*) and (*b*) are views schematically showing a lamp appliance 1 to which the LED lamp 100 emitting light in the forward, sideward, and rearward directions according to an exemplary embodiment the present invention is applied as described above and a lamp appliance 1 to which a conventional LED lamp 100 only emitting light in the forward direction is applied, respectively. In the lamp appliance 1 shown in FIG. 20*a*, light (indicated by solid line) is emitted toward a forward region in a range of 120 degrees by the first LEDs mounted on the top surface of the substrate as described above, and light (indicated by dotted line) is emitted toward a backward region in a range of 240 degrees by the second LEDs mounted on the bottom surface of the substrate. Meanwhile, in the lamp appliance 1 shown in FIG. 20(*b*), light is emitted only toward the forward region in a range of 120 degrees.

According to exemplary embodiments of the present invention, LEDs are respectively mounted on top and bottom surfaces of a substrate so that light can be radiated not only in a forward direction but also in a rearward direction of the substrate, thereby obtaining a characteristic of light distribution similar to that of an incandescent lamp.

Further, a reflection surface is formed by partially changing the shape of a heat sink, and an LED is mounted on a bottom surface of a substrate, so that light which propagates in a rearward direction of the substrate may be reflected by the reflection surface, thereby expanding an orientation angle of the light.

Furthermore, a heat sink is provided with not a dissipation pin and an air flow path connected with an outside of the LED, so that heat generated from an LED can be effectively dissipated.

In the drawings and descriptions, it has been illustrated and described that the reflection surface 124 is formed with an inclined surface and a curved surface. However, the present invention is not limited thereto, and the reflection surface may be formed in various shapes obtained by combining straight and curved lines.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A light-emitting diode (LED) lamp, comprising:

a substrate;

at least one first LED arranged on a first surface of the substrate;

at least one second LED arranged on a second surface of the substrate, the second surface being an opposite side of the substrate from the first surface;

a heat sink comprising a mounting surface, the substrate being arranged on the mounting surface; and a transparent cover covering the substrate, the first LED, and the second LED, wherein the heat sink further comprises a reflection surface, wherein an area of the mounting surface is less than an area of the substrate, and wherein the second surface of the substrate is adjacent to the mounting surface.

2. The LED lamp of claim 1, wherein a distal end of the transparent cover is connected to an edge of the heat sink.

3. The LED lamp of claim 1, wherein the second surface of the substrate directly contacts the mounting surface.

4. The LED lamp of claim 1 , wherein the transparent cover has a height h, and the mounting surface is arranged at a height h/2.

5. The LED lamp of claim 1, wherein the reflection surface contacts the heat sink from a first point corresponding to an edge of the mounting surface to a second point corresponding to the distal end of the transparent cover.

6. The LED lamp of claim 1, wherein the reflection surface comprises a curved surface, which is concave with respect to a straight line between the first point and the second point of the reflection surface.

7. The LED lamp of claim 6, wherein the slope of a first portion of the reflection surface is greater than that of a second portion of the reflection surface.

8. The LED lamp of claim 1, wherein the reflection surface comprises a concave portion and a convex portion.

9. The LED lamp of claim 1, wherein the reflection surface comprises a curved surface that is convex with respect to a straight line between the first point and the second point of the reflection surface.

10. The LED lamp of claim 1, wherein sides of the transparent cover are furthest apart at a height level with the substrate or the second LED.

11. The LED lamp of claim 1, wherein the transparent cover comprises a first portion and a second portion coupled to each other.

12. The LED lamp of claim 11, wherein a boundary between the first portion and the second portion is adjacent to an edge of the substrate.

13. The LED lamp of claim 1, wherein the transparent cover comprises a phosphor.

14. A light-emitting diode (LED) lamp, comprising:

a substrate;

at least one first LED arranged on a first surface of the substrate;

at least one second LED arranged on a second surface of the substrate, the second surface being an opposite side of the substrate from the first surface;

a heat sink comprising a mounting surface, the substrate being arranged on the mounting surface; and a transparent cover covering the substrate, the first LED, and the second LED, wherein the heat sink further comprises a reflection surface, and wherein a plurality of first LEDs are arranged on the first surface of the substrate, a plurality of second LEDs are arranged along an edge of the second surface of the substrate, and the first LEDs are arranged inside the arrangement of the second LEDs.

15. The LED lamp of claim 1, wherein the number of second LEDs is greater than that of first LEDs.

16. A light-emitting diode (LED) lamp, comprising:

a substrate;

at least one first LED arranged on a first surface of the substrate;

at least one second LED arranged on a second surface of the substrate, the second surface being an opposite side of the substrate from the first surface;

a heat sink comprising a mounting surface, the substrate being arranged on the mounting surface; and a transparent cover covering the substrate, the first LED, and the second LED, wherein the heat sink further comprises a reflection surface, and wherein a plurality of second LEDs are arranged on the second surface of the substrate, a plurality of reflecting partition portions protrude in a radial direction from the reflection surface, and a mounting region for the second LEDs on the second surface of the substrate is divided into a plurality of regions by the plurality of reflecting partition portions.

17. The LED lamp of claim 1, wherein a plurality of first LEDs are arranged on the first surface of the substrate, and a mounting region for the first LEDs on the first surface of the substrate is divided into a plurality of regions by a plurality of reflecting partition portions arranged on the first surface of the substrate.

18. A light-emitting diode (LED) lamp, comprising:

a substrate;

at least one first LED arranged on a first surface of the substrate;

at least one second LED arranged on a second surface of the substrate, the second surface being on an opposite side from the first surface;

a heat sink comprising a mounting surface, the substrate being arranged on the mounting surface; and a transparent cover covering the substrate, the first LED, and the second LED, wherein the heat sink further comprises a reflection surface, and wherein a plurality of cover support ribs radially extend along a first portion of the heat sink, the transparent cover comprises a plurality of transparent cover pieces, and each of the plurality of transparent cover pieces is laterally inserted into a gap between adjacent cover support ribs.

19. The LED lamp of claim 1, wherein a plurality of first LEDs are arranged on the first surface of the substrate, a mounting region for the first LEDs is divided into a plurality of regions by a plurality of reflecting partition portions arranged on the first surface of the substrate, and the cover support ribs comprise the reflecting partition portions.

20. The LED lamp of claim 1, wherein the heat sink comprises an air flow path arranged in the heat sink to a first depth, the air flow path configured so that air from outside the LED may flow into the heat sink.

21. The LED lamp of claim 20, wherein the transparent cover has a height h, and wherein a first end of the air flow path is arranged at a height h/2.

22. A light-emitting diode (LED) lamp, comprising:

a substrate;

at least one first LED arranged on a first surface of the substrate;

at least one second LED arranged on a second surface of the substrate, the second surface being an opposite side of the substrate from the first surface;

a heat sink comprising a mounting surface, the substrate being arranged on the mounting surface; and a transparent cover covering the substrate, the first LED, and the second LED, wherein the heat sink further comprises a reflection surface, wherein the reflection surface at least partially covers the second LED.

23. A light-emitting diode (LED) lamp, comprising:

a substrate;

at least one first LED arranged on a first surface of the substrate;

at least one second LED arranged on a second surface of the substrate, the second surface being an opposite side of the substrate from the first surface;

a heat sink comprising a mounting surface, the substrate being arranged on the mounting surface; and a transparent cover covering the substrate, the first LED, and the second LED, wherein the heat sink further comprises a reflection surface, wherein the sum of the areas of the second surface and the mounting surface equals the area of the first surface.

24. The LED lamp of claim 8, wherein the reflection surface comprises a height h, and wherein the concave portion and the convex portion form a boundary at h/2.

25. The LED lamp of claim 1, wherein one of the first LED and the second LED emits light above the substrate and the other of the first LED and the second LED emits light below the substrate.

26. The LED lamp of claim 14, wherein a number of second LEDs is greater than a number of first LEDs.

27. The LED lamp of claim 18, wherein a plurality of first LEDs are arranged on the first surface of the substrate, a mounting region for the first LEDs is divided into a plurality of regions by a plurality of reflecting partition portions arranged on the first surface of the substrate, and the cover support ribs comprise the reflecting partition portions.

* * * * *